US005625165A

United States Patent [19]

Wight et al.

[11] Patent Number: 5,625,165

[45] Date of Patent: Apr. 29, 1997

[54] DESENSITIZED ENERGETIC MATERIALS

[76] Inventors: Charles A. Wight, 1457 E. 1300 South, Salt Lake City, Utah 84105; Peter M. Kligmann, 735 E. 4565 S., Murray, Utah 84107

[21] Appl. No.: 844,014

[22] Filed: Feb. 24, 1992

[51] Int. Cl.[6] ..... C06B 45/00; C06B 47/08; C06B 25/34

[52] U.S. Cl. ..... 149/2; 149/36; 149/92; 149/109.6

[58] Field of Search ..... 149/109.6, 2, 36, 149/92

[56] References Cited

U.S. PATENT DOCUMENTS

| | | | |
|---|---|---|---|
| 3,904,985 | 9/1975 | Robinson et al. | 331/94.5 |
| 3,975,501 | 8/1976 | Gordon et al. | 423/351 |
| 4,001,380 | 1/1977 | Gordon et al. | 423/406 |
| 4,091,081 | 5/1978 | Woytek et al. | 423/406 |
| 4,632,712 | 12/1986 | Abegg et al. | 149/2 |
| 4,632,714 | 12/1986 | Abegg et al. | 149/2 |
| 4,759,179 | 7/1988 | Bernard et al. | 60/218 |
| 4,874,949 | 10/1989 | Mishra et al. | 149/19.3 |
| 4,875,949 | 10/1989 | Mishra et al. | 149/19.3 |
| 5,009,728 | 4/1991 | Chan et al. | 149/19.1 |

*Primary Examiner*—Charles T. Jordan
*Assistant Examiner*—Anthony R. Chi

[57] ABSTRACT

Method is provided for reducing the sensitivity of energetic materials (explosives, propellants and the like) to detonation induced by mechanical shock or by application of pronounced heat, e.g. by a laser beam. Examples of such energetic materials are fluorine azide and chlorine azide which are model HEDM propellants which are prone to accidental detonation in the solid state. The polycrystalline forms of such solids are sensitive to and readily detonated by, mechanical shock and pulsed laser photolysis. The method of the invention serves to desensitize such energetic materials by forming them as amorphous (disordered) solids by vapor deposition thereof onto a relatively cold substrate, which amorphous form desensitizes them relative to more conventional polycrystalline forms of these energetic materials though both contain about the same amount of chemical energy.

14 Claims, 1 Drawing Sheet

DESENSITIZED ENERGETIC MATERIALS

STATEMENT OF GOVERNMENT INTEREST

The invention described herein may be manufactured and used by or for the Government for governmental purposes without the payment of any royalty thereon.

BACKGROUND OF THE INVENTION

1. Field of the Invention

This invention relates to a method for desensitizing high energetic materials particularly those susceptible to accidental explosions due to mechanical shock and the desensitized energetic materials produced thereby.

2. The Prior Art

Solid energetic materials find wide use as, e.g. fuel or as propellants for air and space craft or as explosives with war and peace uses. These materials can of course be dangerous to transport and store and ways must be found for making such materials less susceptible to accidental explosions due to mechanical shock. That is, it would be highly useful to enhance the safety of, e.g. conventional explosives and rocket propellants.

It has been reported in the prior art that a specific energetic material, fluorine azide, $FN_3$, explodes spontaneously when cooled to liquid nitrogen temperature, i.e. 77 K. A similar result occurred with chlorine azide, $ClN_3$. That is, the above azides are examples of energetic materials which spontaneously detonate if cooled to 77 K (−321° F.) without undergoing mechanical shock. Attempts have been made in the prior art to desensitize energetic materials to reduce accidental explosions induced by mechanical shock. See for examples U.S. Pat. No. 5,009,728 to Chan et al (1991), U.S. Pat. No. 4,875,949 to Mishra et al (1989) and U.S. Pat. No. 4,632,714 to Abegg et al (1986). These references teach dissolving or dispersing energetic materials in a binder or fuel continuum matrix resulting in a solid composite of reduced sensitivity to mechanical shock but also of reduced power due to the dilutive nature of the matrix employed.

Accordingly there is a need and market for an approach which results in desensitized energetic materials while minimizing the impairment of power thereof caused by the less active filler material or matrix.

There has now been discovered a method for desensitizing energetic materials relative to explosion due to mechanical shock or even to application of heat by, e.g. certain laser beams, without greatly impairing, diluting or diminishing the power thereof, e.g. by dispersing or embedding such energetic materials in a lower energy matrix.

SUMMARY OF THE INVENTION

Broadly, the present provides a method for making an energetic material less accidentally explosive due to mechanical shock or application of heat comprising, forming such material as an amorphous solid.

Preferably such energetic material is slowly deposited on a surface at reduced temperatures and pressures as more fully discussed below.

Alternatively, the material can be formed as an amorphous solid by rapid cooling of the melt or as an amorphous mixture of two or more energetic materials which are cooled rapidly from the melt in order to prevent the formation of crystals.

The invention also provides desensitized energetic materials comprising materials which have been vapor deposited on a colder surface slowly enough to form an amorphous layer thereof.

The energetic materials include well-cooled azides, cyclic nitramines, ozones or other energetic materials.

BRIEF DESCRIPTION OF THE DRAWINGS

The invention will become more apparent from the following detailed specification and drawings in which.

DESCRIPTION OF PREFERRED EMBODIMENTS

Figure 1:
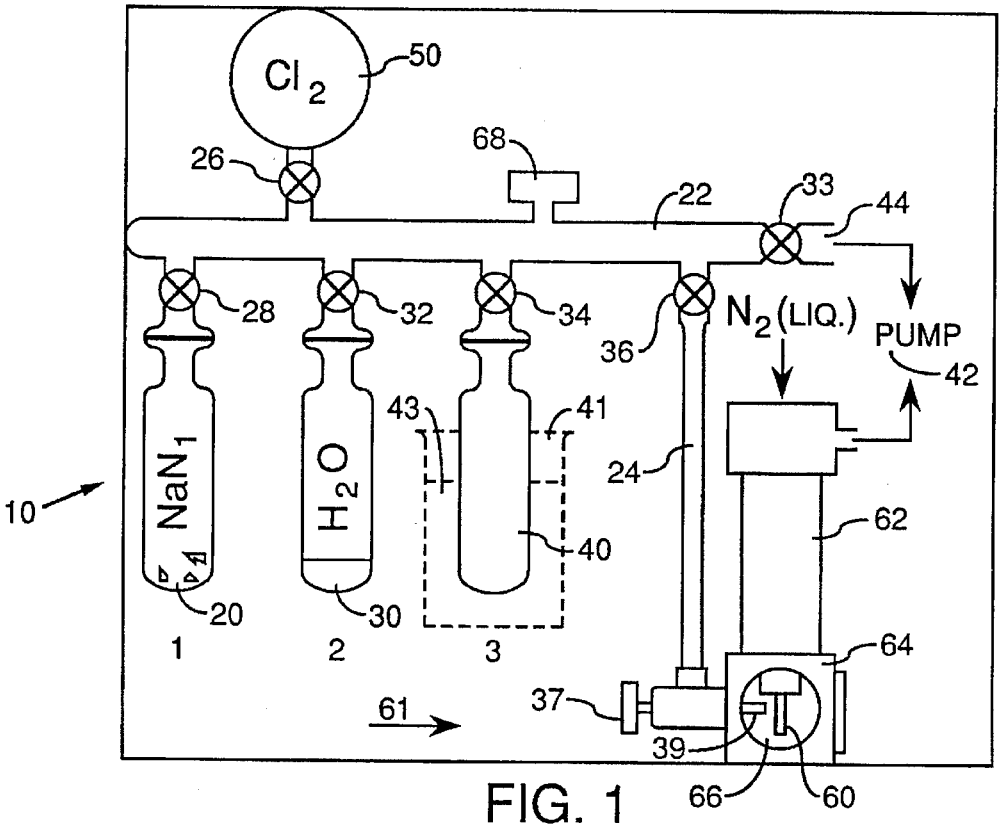
FIG. 1 is an elevation schematic view of an apparatus for carrying out a method embodying the present invention and FIG. 2 shows infrared absorption spectra of desensitized energetic materials prepared per the method of the present invention.

As noted above it was reported in 1987 in the prior art that thin films of $FN_3$, when cooled to 77 K, would either explode spontaneously or be highly sensitive to pulsed laser-induced detonation. It was believed by the applicants herein that polycrystalline $FN_3$ had been employed in such prior art tests.

Applicants then hypothesized that if $FN_3$ were formed as an amorphous (disordered) solid, such material might be desensitized with respect to detonation. To test such hypothesis, small quantities of another azide, $ClN_3$ were synthesized and deposited as a thin film on the surface of a CsI optical window. A series of such azide films were deposited at varying deposition rates and substrate temperatures.

As above indicated, numerous tests were run in which thin films of pure solid Chlorine Azide, $ClN_3$ were formed by deposition of the room temperature vapor directly onto the surface of a pre-cooled salt (CsI) window at 77–120 K. Crystalline films were formed by rapid vapor deposition onto such window at temperatures above 100 K whereas amorphous samples were formed by slow deposition thereon. At intermediate vapor deposition rates, semi-crystalline or partial crystalline amorphous films were formed as well.

It is noted that to obtain crystalline azide film, one needs to 1) deposit the azide vapor at a rapid rate, i.e. over 25 nm/sec and 2) onto a 'warm' surface. For the azides, $FN_3$ and $ClN_3$, 110–120 K or more is warm. For $O_3$, 60 K or over is warm. To form an amorphous layer of the above three energetic materials, one may omit either of the above two parameters, i.e. vapor deposit slowly on a warm substrate (e.g. per claim 9 hereof) or vapor deposit at a rapid rate onto a cold substrate or surface (e.g. per claim 10 hereof) relative to the above three energetic materials.

For deposition rates one looks at the film thickness growth rate. That is, a slow deposition rate is one at 3–25 nm/sec or less and a rapid deposition rate is one from 25 to 1000 or more nm/sec.

It was found that the crystalline samples could be detonated by subjecting them to pulses of ultraviolet light from an excimer laser. On the other hand, it proved quite difficult to cause explosions in amorphous films of such sample of, e.g. $ClN_3$. Such amorphous sample was found to tolerate many thousands of laser pulses, each of which would normally cause an explosion in a crystalline sample thereof.

Infrared spectra of the above film samples showed that polycrystalline, semicrystalline or amorphous films could be formed, depending on the deposition rate and substrate temperature, as indicated above. The crystalline film samples were found to be quite sensitive to pulsed laser detonation whereas the amorphous films proved quite resistant thereto.

An apparatus was then assembled to measure the speed at which these explosions travel across the surface of a sample. Such apparatus and a procedure for the use thereof, is described more fully in an Article by Charles A. Wight entitled *Stability of High Energy Amorphous Materials,* which paper was orally presented at the "Proceedings of the High Energy Density Matter (HEDM) Conference", held 24 February 1991, in Albuquerque, N.M., report of which in printed form, was released for publication in October 1991, which Article is incorporated herein by reference.

Using the above apparatus in a series of tests on film samples, it was found that the velocity of the detonation wave was found to be sensitive to the degree of crystallinity of the sample, varying from 1330 m/s in crystalline samples to about 640 m/s in amorphous samples. These results not only demonstrate that it is much more difficult to initiate an explosion in an amorphous film, but that such explosions propagate more slowly therein as well.

The following example is intended as an illustration of the method of the present invention and should not be construed in limitation thereof.

EXAMPLE I

Chlorine azide, $ClN_3$, was synthesized in a defusion-pumped glass vacuum manifold, as shown schematically in FIG. 1. About 20 mg of sodium azide was placed in finger 20 of the manifold 10 as shown in FIG. 1. The finger 20 was then evacuated by pump 42 through lines 44 and 22, valves 28 and 33 being opened for that purpose. Valve 33 was closed and valves 26 and 32 were opened and about 2.5 torr-liter of chlorine gas from its container 50 and 1.25 torr-liter of water vapor from its finger 30, were discharged into the line 22 and admitted through open valve 28 into the finger 20 (which had been precooled to 77° K) and condensed therein in the presence of the above-noted sodium azide. Then all the above valves were closed and the resulting mixture in the finger 20 was allowed to react at room temperature for 40–80 minutes. Following the reaction, valves 28 and 34 were opened and the gaseous products from finger 20 were discharged into finger 40 (which had been pre-cooled to 77 K) and condensed therein, as indicated in FIG. 1.

Valves 34 and 33 were then opened and pump 42 was activated and heating was begun of finger 40 (by removing it from a dewar flask 41 filled with liquid nitrogen 43 and exposing such finger to room temperature, as indicated in FIG. 1) to draw off from such finger, volatile impurities, e.g. unreacted $Cl_2$ as well as $H_2O$ and $HN_3$. The pressure in manifold or line 22 was monitored by manometer 68 and when it dropped to, e.g. $10^{-4}$ to $10^{-5}$ torr, indicating that most of such volatiles had been drawn off, valve 33 was closed and pump 42, of FIG. 1, was turned off.

As finger 40 continued to warm, $ClN_3$ vaporized and began to build pressure in the manifold 22, which again was monitored by manometer 68. When the pressure in such manifold 22 reached 2 torr, valve 34 was closed and valves 36 and 37 were opened to charge such azide vapors through pipe 24 and into the dewar vessel 62, to be deposited as a film sample, directly onto the window 60 (of, e.g. CsI or quartz) which window was cryogenically cooled by liquid nitrogen in such (stainless steel vacuum) dewar vessel 62. Such vessel 62 was equipped with a rotatable shroud 64 and optical windows, e.g. window 66, for obtaining IR or UV absorption spectra of the film samples. The window 60 is shown in an edge-on view in FIG. 1, the face of which (as seen from the vantage of arrow 61) can be angular or rounded.

The above deposition procedure was repeated for various deposition rares (controlled by adjustment of valve 36) and various deposition window temperatures, to obtain crystalline, semi-crystalline or amorphous film samples as further discussed below.

Figure 2:
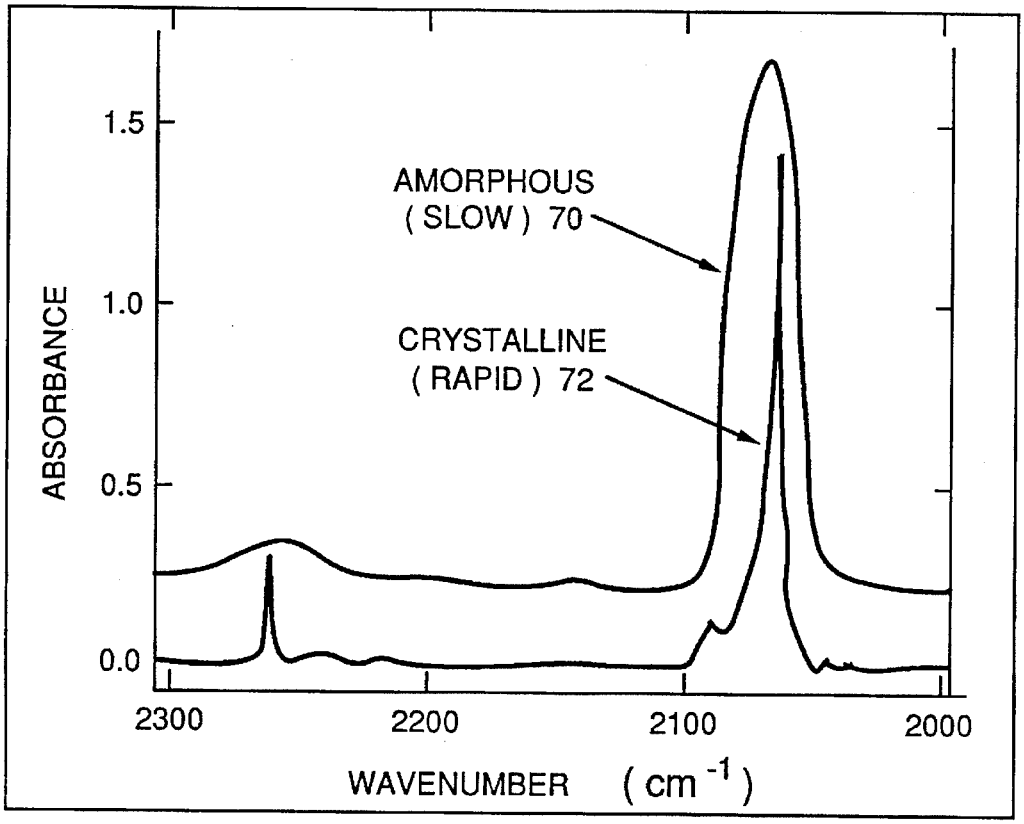

That is, employing the above apparatus and method, several amorphous samples of $ClN_3$ were formed by (slow) vapor deposition onto a CsI window at 77 K. A portion of the infrared spectrum is shown in FIG. 2. Spectra of the amorphous samples, per curve 70, were characterized by broad, unstructured absorption bands (FWHM=22.5 $cm^{-1}$ at 2070 $cm^{-1}$). The breadth of the bands is presumably due to inhomogeneous broadening associated with a distribution of micro-environments of different $ClN_3$ molecules in the disordered solid.

Then crystalline samples of $ClN_3$ were formed by rapid vapor deposition onto a substrate at elevated temperatures, usually 120 K. The infrared spectrum of the crystalline samples, per curve 72, shows that the absorption bands of such samples are considerably narrower than their amorphous counterparts because all of the molecules in the crystal have essentially the same micro-environment. It has been found the IR spectroscopy is a useful diagnostic for assessing the degree of crystallinity for this (azide) compound. That is, infrared spectra of the film so formed, show that polycrystalline, semicrystalline or amorphous films can be formed depending on the deposition rate and the substrate temperature.

Crystalline samples exposed to the unfocused output of a XeCl excimer laser (308 nm, 15 nm pulse width, 10 $mJ/cm^2$ fluence) detonated with unit probability. The explosion was accompanied by a flash of visible light and an audible report even though the sample was under vacuum at the time of detonation.

Amorphous samples (of the azide) on the other hand were quite difficult to detonate with the laser. It was found that some samples which had been deposited rapidly onto a 77 K substrate could be detonated with a focused UV laser pulse (approximately 2 $J/cm^2$ fluence) but samples which were deposited slowly often did not detonate, even when the laser fluence was high enough to vaporize a small spot on the sample window.

Detonation velocity measurements of crystalline and amorphous samples were taken employing the apparatus and method referred to above, the description of which is found in an article incorporated herein by reference as previously noted.

The detonation velocity for crystalline samples was found to be about 1330 m/s. This value is typical for thin film detonations of several inorganic azides. Amorphous samples exhibited a detonation velocity of 640 m/s. Additional measurements for semi-crystalline samples formed at deposition temperatures of 90 and 100 K are shown below in Table 1.

TABLE I

Detonation velocities for thin-film chlorine azide

| Deposition Temperature | Sample Character | Detonation Velocity (m/s) |
|---|---|---|
| 120K | crystalline | 1330 |
| 100K | semi-crystalline | 1040 |
| 90K | semi-crystalline | 820 |
| 77K | amorphous | 640 |

Thus as discussed above, the present invention shows that amorphous solids are considerably more resistant to accidental explosions than are their crystalline counterparts even though both kinds of solids contain essentially the same amount of chemical energy. Thus the method of the invention can serve to modify the reactive properties of important energetic materials or High Energy Density Materials (HEDM) such as solid rocket propellants in order to increase the margin of safety for technicians who handle them in large quantities.

Accordingly, the invention teaches forming energetic materials as amorphous solids (rather than as densely packed microcrystals per the prior art) which makes such materials less susceptible to accidental detonation due to mechanical shock or application of heat, e.g. a laser beam, so as to enhance the safety of solid fuels, conventional explosives, rocket propellants and other solid energetic materials.

The method of the present invention also makes possible the design of new higher energy materials which could be handled, shipped and stored in their amorphous form with reasonable safety, which materials would otherwise be considered too hazardous to handle in the crystalline form of present-day prior art practice.

Stated another way the method of the present invention provides for forming amorphous energetic materials with the advantage of decreasing the impact sensitivity of virtually any solid propellant or explosive, thus decreasing the probability of accidental ignition or explosion thereof. Such method can be used either to increase safety margins with commercial propellants and explosives currently in use or to develop more energetic materials with lower impact sensitivities than could otherwise be achieved with safety using conventional methods of preparation.

Examples of the above explosives or propellants are the azides, including $FN_3$, $ClN_3$ and $O_3$ as well as nitramine propellants. These latter propellants include "RDX" or hexahydro-1,3,5-trinitro-1,3,5-triazine and "HMX" or 1,3,5,7-tetranitro-1,3,5,7-tetraaza-cyclo octane.

Potential practical applications of the method and product of the present invention include preparation of propellants for solid rocket motors, missiles, ammunition and heavy artillery. The desensitized amorphous energetic materials of the invention can also be used to enhance the safety of storing solid energetic materials for chemical processing, chemical lasers, fuels, propellants, pyrotechnics or explosives.

The vapor deposition of energetic materials per the method of the invention is desirably carried out at reduced pressures of $10^{-4}$ torr or less and at cryogenic temperatures at the surface of deposition. That is, temperatures of 100 K or less, including down to 4 K or down to 2.7 K for the azide solid layers including film and 60 K or less including down to 10 K for the ozone solid layers or films.

The surface of such HEDM deposition can be e.g. mirrors of quartz, $CaF_2$ CsI and other related deposition surfaces.

The vapor deposition rate referred to above can be controlled by the amount, e.g. valve 37 is opened and/or by the size of the inlet nozzle 39 directed toward the sample window 60, as shown in FIG. 1.

What is claimed is:

1. A method for making an energetic material less accidentally explosive due to mechanical shock or application of heat comprising, forming said material as an amorphous solid by deposition of the vapor of said energetic material onto a cold surface.

2. The method of claim 1 wherein the energetic material is deposited on said cold surface as a layer including a film.

3. The method of claim 1 wherein said material is an HEDM explosive or propellant.

4. The method of claim 1 wherein said energetic material is selected from the group consisting of an azide, a cyclic nitramine and ozone.

5. The method of claim 1 wherein said deposition is conducted at a pressure of $10^{-torr}$ or less and at a deposition surface temperature of 100 K or less.

6. The method of claim 1 wherein the slow vapor deposition takes place at a layer growth rate of 3–25 nm/sec.

7. The method of claim 1 wherein said vapor deposition takes place onto a cold surface selected from the group consisting of optical windows of quartz, $CaF_2$ and CsI.

8. The method of claim 1 wherein said amorphous solid is formed by slow vapor deposition of said vapor on a substrate cooled to a temperature of 120 K or below for $FN_3$ and $ClN_3$ and 60 K or below for $O_3$.

9. The method of claim 1 wherein said amorphous material is formed by a relatively rapid deposition of said vapor on a substrate at a temperature below 120 K for $FN_3$ and $ClN_3$ and below 60 K for $O_3$.

10. Desensitized energetic materials comprising, materials which have been vapor deposited on a cold surface slowly enough to form an amorphous layer thereof.

11. The materials of claim 10 being HEDM explosives or propellants.

12. The materials of claim 10 being selected from the group consisting of an azide, a cyclic nitramine and ozone which include $FN_3$, $ClN_3$ and $O_3$ maintained at a temperature of 100 K or less.

13. The materials of claim 10 being deposited on a cooled surface selected from the group consisting of quartz, $CaF_2$ or CsI.

14. The materials of claim 10 wherein said amorphous layer is a thin film, film, thick film or thicker layer.

* * * * *

UNITED STATES PATENT AND TRADEMARK OFFICE

CERTIFICATE OF CORRECTION

PATENT NO. : 5,625,165

DATED : Apr 29 1997

INVENTOR(S) : Charles A. Wight et al

It is certified that error appears in the above-identified patent and that said Letters Patent is hereby corrected as shown below:

On the title page, before item [57], insert the following:

-- Attorney, Agent or Firm - Thomas C. Stover --.

Signed and Sealed this

Second Day of December, 1997

*Attest:*

Bruce Lehman

BRUCE LEHMAN

*Attesting Officer*

*Commissioner of Patents and Trademarks*